US007196011B2

(12) United States Patent
Cho et al.

(10) Patent No.: US 7,196,011 B2
(45) Date of Patent: Mar. 27, 2007

(54) APPARATUS AND METHOD FOR TREATING SUBSTRATES

(75) Inventors: Chan-Woo Cho, Gyeonggi-do (KR); Jae-Phil Boo, Gyeonggi-do (KR); Myung-Seok Kim, Gyeonggi-do (KR); Jong-Muk Kang, Gyeonggi-do (KR); Ik-Joo Kim, Gyeonggi-do (KR); Jung-Hwan Sung, Gyeonggi-do (KR); Ki-Hong Jung, Gyeonggi-do (KR); Keon-Sik Seo, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 33 days.

(21) Appl. No.: 11/036,865

(22) Filed: Jan. 13, 2005

(65) Prior Publication Data

US 2005/0153557 A1 Jul. 14, 2005

(30) Foreign Application Priority Data

Jan. 12, 2004 (KR) ..... 10-2004-0002004
May 14, 2004 (KR) ..... 10-2004-0034351

(51) Int. Cl.
*H01L 21/469* (2006.01)

(52) U.S. Cl. ..... 438/692; 438/691; 438/689; 451/5; 451/6; 451/285; 451/287; 451/288; 451/398; 216/85; 216/88; 216/89

(58) Field of Classification Search ..... 156/345.12; 216/85, 88; 438/7, 8; 451/5, 6
See application file for complete search history.

(56) References Cited

U.S. PATENT DOCUMENTS 5,829,256 A 11/1998 Rada
6,511,363 B2 1/2003 Yamane et al.
6,827,629 B2 * 12/2004 Kim et al. ..... 451/5
6,962,007 B1 * 11/2005 Maeda et al. ..... 34/585

FOREIGN PATENT DOCUMENTS

EP 1 120 194 A2 8/2001

(Continued)

OTHER PUBLICATIONS

S. Wolf, Silicon Processing for the VLSI Era, Lattice Press (2002), pp. 388,389,392,393,400,401 and 406.*

(Continued)

*Primary Examiner*—Nadine G. Norton
*Assistant Examiner*—Maki Angadi
(74) *Attorney, Agent, or Firm*—Marger Johnson & McCollom, P.C.

(57) ABSTRACT

The present invention relates to a polishing apparatus for polishing a workpiece such as a semiconductor wafer to a flat mirror finish, and more particularly to a polishing apparatus having a workpiece transfer robot for transferring a workpiece from one operation to the next.

The polishing apparatus according to the present invention comprises a polishing section including a top ring for holding a workpiece to be polished and a turntable having a polishing surface for polishing a surface of the workpiece held by the top ring; a cleaning section including a cleaning device for cleaning the workpiece that has been polished in the polishing section; and a workpiece transfer robot for transferring the workpiece to be polished to the polishing section or for transferring the workpiece that has been polished to the cleaning section. In this case, the workpiece transfer robot comprises a robot body; at least one arm operatively coupled to the robot body by at least one joint; a holder mechanism mounted on the arm for holding the workpiece; and a seal mechanism at the joint for preventing liquid from entering an interior of the joint, the seal mechanism.

29 Claims, 15 Drawing Sheets

FOREIGN PATENT DOCUMENTS

| | | |
|---|---|---|
| KR | 1995-0015628 | 6/1995 |
| KR | 1998-024292 | 7/1998 |
| KR | 1998-0005759 | 1/1999 |
| KR | 2001-0049569 | 6/2001 |
| KR | 2002-0025834 | 4/2002 |
| KR | 2002-0093248 | 12/2002 |
| KR | 2003-0063320 | 7/2003 |
| KR | 2003-0097413 | 12/2003 |
| KR | 2004-0049492 | 6/2004 |
| WO | WO 99/25520 A2 | 5/1999 |

OTHER PUBLICATIONS

English language abstract of Korean Publication No. 2002-0093248.
English language abstract of Korean Publication No. 2003-0097413.
English language abstract of Korean Publication No. 2003-0063320.
English language abstract of Korean Application No. 2004-0049492.
English language abstract of the Korean Publication No. 1995-0015628.
English language abstract of the Korean Publication No. 1998-0005759.
English language abstract of the Korean Publication No. 1998-024292.
English langauge abstract of the Korean Publication No. 2001-0049569.
English language abstract of the Korean Publication No. 2002-0025834.

* cited by examiner

APPARATUS AND METHOD FOR TREATING SUBSTRATES

PRIORITY STATEMENT

This application claims the priority of Korean Patent Application No. 2004-34351, filed on May 14, 2004, and Korean Patent Application No. 2004-02004, filed on Jan. 12, 2004 in the Korean Intellectual Property Office, the disclosure of which is incorporated herein in its entirety by reference.

BACKGROUND OF THE INVENTION

1. Field of the Invention

The present invention relates to an apparatus and method for treating semiconductor substrates and, more particularly, to an apparatus and method for chemically mechanically polishing and cleaning semiconductor substrates.

2. Description of Related Art

A process for manufacturing semiconductor devices comprises a deposition process for forming a thin film on a wafer and an etch process for forming a fine circuit pattern on the thin film. These processes are iteratively performed until a desired circuit pattern is formed on the wafer. In this case, many curvatures are produced. With the recent trend toward finer semiconductor devices, the line widths of circuits are smaller and more interconnections are stacked on a chip. For this reason, a step difference based on inner positions of the chip increases. The step difference makes it hard to uniformly coat a conductive layer in a subsequent process and causes a defocusing in a photolithographic process.

In view of the foregoing, there exist many ways for planarizing a wafer surface. As wafer calibers become larger, chemical mechanical polishing (CMP) has been widely used in recent years because a superior planarity can be achieved at not only a narrow area, but also wide area.

Typically, there are two methods for polishing wafers up to a target thickness during a CMP process. One is a time method, and the other is an endpoint detecting method. In the time method, a user sets the polishing time according to the thickness, and kinds of layers and wafers are polished for this set time. Unfortunately, the time method cannot polish wafers to an exact thickness due to the abrasion state of expendable supplies such as polishing pads or polishing conditioners used in a polishing process, the pressure of the polishing head for pressurizing wafers during the polishing process, hunting in the amount of slurries supplied, and the various states of layers.

The endpoint detecting method is classified further into a motor current detecting method and an optical detecting method. The motor current detecting method is a method for detecting the variation of a load applied to a motor resulting from a frictional force of two different layers. The motor current detecting method is advantageous in the cases where a polishing point is a boundary of an upper layer and a lower layer, but the method cannot be used in the case where a polishing point is the specific point of a single layer. The optical detecting method is a method using an intrinsic reflectivity of a material. Specifically, the optical detecting method uses a combination of waveforms reflected at a surface of a layer and at a boundary face of layers from a scanned regular wavelength beam. The optical detecting method is advantageous in the case where an upper point or a lower point is clear-cut, but this method cannot be used in the case that the upper or lower point is not clear-cut or the desired thickness is small. It is therefore hard to polish wafers to an exact thickness with currently used polishing methods.

Generally, a cleaning apparatus is disposed at one side of a polishing apparatus to remove extra substances such as slurries remaining on a wafer after a polishing process is performed. A typical cleaning apparatus has a cleaning module, a plurality of etchant treating modules, and a drying module. A completely polished wafer is cleaned using deionized water (DI water) from the cleaning module. The wafer is then rinsed at a module using a mixed chemical containing ammonia, hydrogen peroxide, and DI water. After being cleaned by a brush at a module using hydrofluoric acid (HF) as a chemical, the wafer is dried by a spin driver in the drying module. In the case that the cleaning process is performed using the above-described procedure, slurry residues and particles of the brush may remain attached to the wafer. Afterwards, the wafer is transferred to a wet station to be rinsed using the mixed chemical and is dried using isopropyl alcohol (IPA) based on Marangoni effect. Thus, duplicate time is required for cleaning wafers due to the slurry residues and the particles of the brush. In the respective modules of the cleaning apparatus, wet wafers are transferred to the modules by means of a transfer unit. Accordingly, the chemical may drop on the modules thereby staining or contaminating the modules.

SUMMARY OF THE INVENTION

A method and system of treating substrates is provided that polishes substrates to a more accurate thickness, reduces the time required to polish substrates, and prevents cleaning apparatuses from being contaminated by a chemical dropping from a substrate during a cleaning process.

One embodiment provides a method including intermediate and final polishing steps. In the intermediate polishing step, the substrate is polished to a reference point using an endpoint detection method. In the final polishing step, the substrate is polished for a polishing time that is computed from data measured during a final polishing step of a previously polished substrate.

Another embodiment provides a further method including cleaning the polished substrate by loading the polished substrate onto a cleaning apparatus. The cleaning apparatus cleans the substrate using deionized water (DI water). Then the cleaning apparatus cleans the substrate at an initial chemical cleaning step using a solution including hydrofluoric acid (HF). Then the cleaning apparatus cleans the substrate in a final chemical cleaning step by dipping the substrate in a solution including ammonia, hydrogen peroxide, and DI water. The cleaning apparatus then dries the substrate in a drying step. The substrate can be dried after each cleaning step to prevent contamination of the cleaning apparatus by chemicals dropping from the substrate.

Yet another embodiment provides a system for treating substrates that includes a chemical mechanical polishing apparatus. The apparatus includes a polishing part, a measuring part and a polishing control system. The polishing control system includes an intermediate polish controller and a final polish controller for controlling the intermediate and final polishing, respectively, of the substrate. The intermediate polishing is done using an endpoint detection method and the final polishing is done using a time method based on closed loop control.

And yet another embodiment provides a further system that includes a cleaning apparatus. The cleaning apparatus includes modules for rinsing, chemically cleaning, and drying the substrate. Each of the rinsing and chemical cleaning modules can include a nozzle supplying a drying gas to dry the substrate prior to transferring the substrate to a next module.

DETAILED DESCRIPTION OF THE INVENTION

Figure 1:
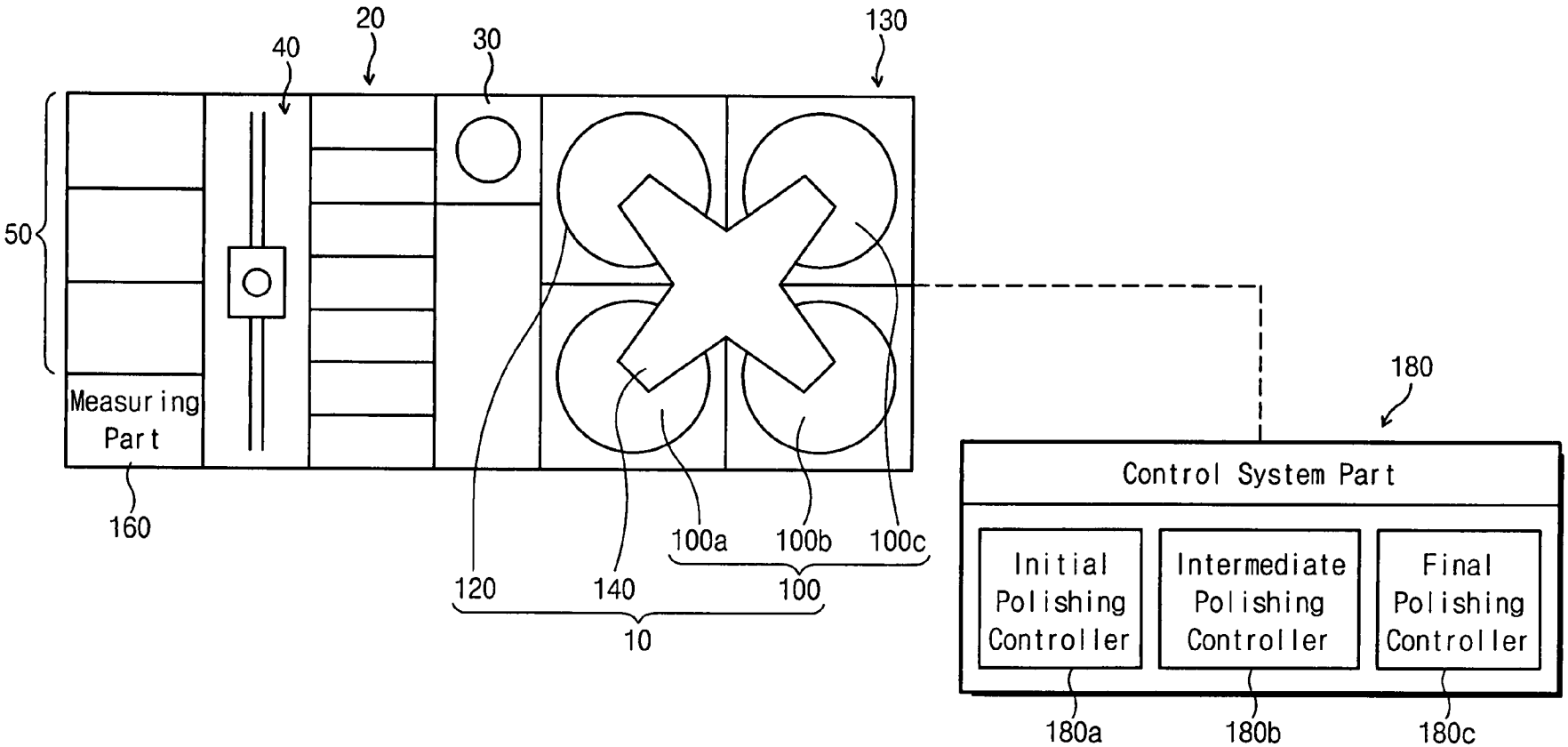
FIG. 1 shows a substrate treating equipment according to an embodiment of the present invention.

As illustrated in FIG. 1, substrate treating equipment according to the invention includes a polishing apparatus 10 and a cleaning apparatus 20. The polishing apparatus 10 is disposed at one side, and the cleaning apparatus 20 is disposed abreast at a lateral face of the polishing apparatus 10. A transfer robot 30 is installed between the polishing apparatus 10 and the cleaning apparatus 20 to transfer a wafer therebetween. A plurality of load stations 50 are arranged lateral to the cleaning apparatus 20. A carrier containing wafers is placed on the load station 50. The polishing apparatus 10 performs a polishing process to polish layers of a wafer, and the cleaning apparatus 20 removes extra substances such as slurries attached onto the wafer after the polishing process.

The polishing apparatus 10 has a polishing part 130, a measuring part 160, and a control system part 180. The polishing part 130 is disposed in the polishing apparatus 10 to directly polish wafers. The measuring part 160 measures a pre-polish wafer thickness and a post-polish wafer thickness and may be disposed in a terminal of the load station 50. Further, the measuring part 160 measures a thickness of a to-be-polished layer. If the to-be-measured layer is composed of an upper layer and a lower layer, the measuring part 160 measures a thickness of the lower layer. Alternatively, the measuring part 160 measures a post-polish wafer thickness and a piece of equipment for performing pre-polish processes (e.g., deposition equipment; not shown) measures the pre-polish wafer thickness.

Figure 2:
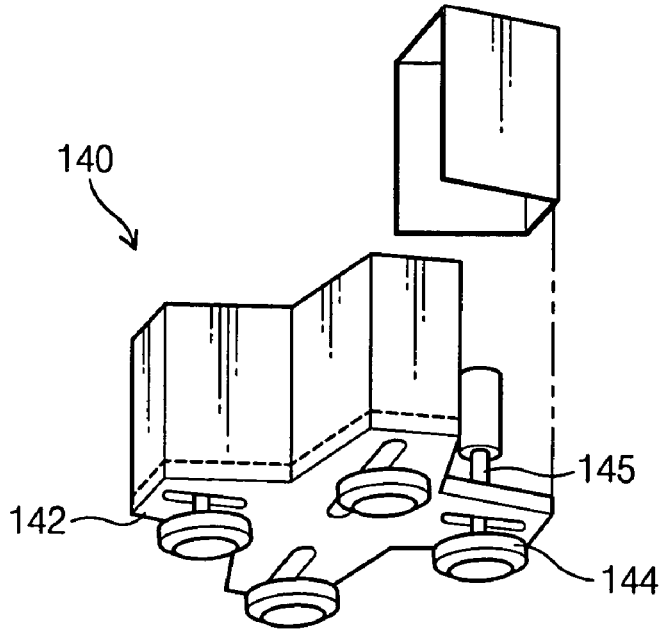
FIG. 2 is a perspective view of a polishing part shown in FIG. 1.
Figure 2:
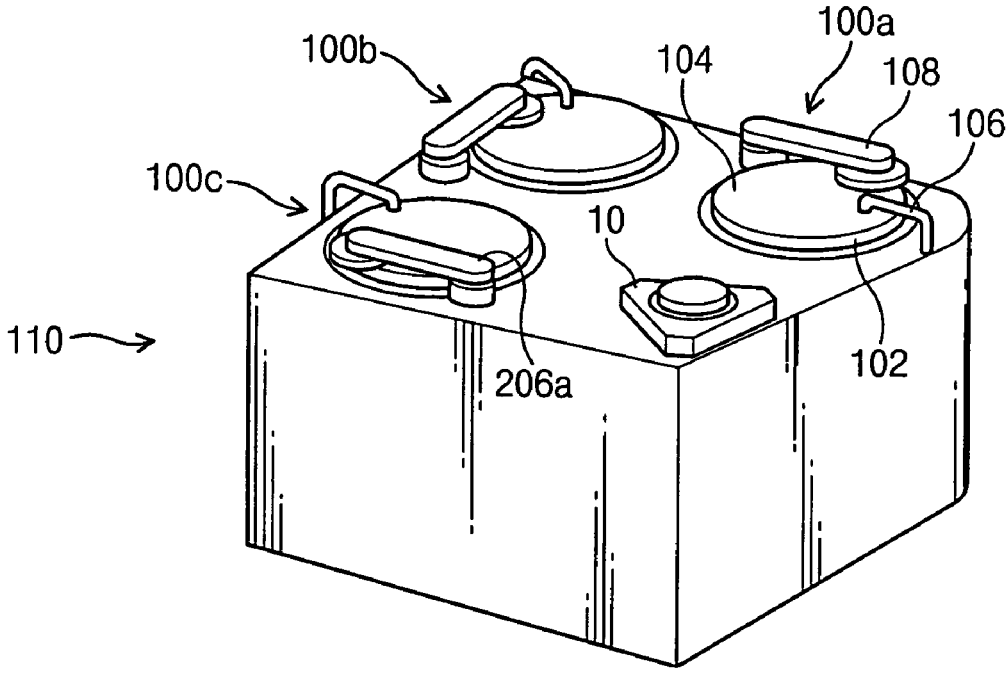

Referring to FIG. 2 and FIG. 1, the polishing part 130 has an initial plate portion 100*a*, an intermediate plate portion 100*b*, a final plate portion 100*c*, a load cup 120, and a polishing head assembly 140. The load cup 120 and the plate part 100 are disposed foursquare. The load cup 120 is disposed to be adjacent to the cleaning apparatus 20. The plate portions 100*a*, 100*b*, and 100*c* are arranged in a counterclockwise direction, in the order named. Each plate portion 100*a*, 100*b*, and 100*c* includes a platen 102 to which a polishing pad 104 is attached, a slurry supply arm 106 for supplying slurries to the polishing pad 104 during a polishing process, and a pad conditioner 108 for keeping the polishing pad with a suitable roughness. The polishing head assembly 140 has a cruciform supporting plate 142 having four terminals each being combined with a polishing head 144. The polishing head 144 adsorbs a wafer under a vacuum state while transferring the wafer and applies a regulatable pressure to the wafer during a polishing process. The polishing heads 144 revolves on its axis 145, and the polishing head assembly 140 also revolves on its axis 15. Wafers are polished by the polishing head assembly 140 through the initial, intermediate, and final plate portions 100*a*, 100*b*, and 100*c*.

Returning to FIG. 1, the control system part 180 controls the degree a wafer is polished at the plate parts 100*a*, 10*b*, and 100*c*. The control system part 180 includes: an initial polishing controller 180*a* for controlling the degree a wafer is polished at the initial plate portion 100*a*; an intermediate polishing controller 180*b* for controlling the degree a wafer is polished at the intermediate plate portion 100*b*; and, a final polishing controller 180*c* for controlling the degree a wafer is polished at the final plate portion 100*c*. At the initial plate portion 100*a*, a wafer is polished to a predetermined thickness. At the intermediate plate portion 100*b*, the wafer is polished to a reference point. At the final plate portion 100*b*, the wafer is polished until it reaches a target thickness. In the case that a to-be-polished layer of the wafer is a multi-layered layer composed of an upper layer (60*a* of FIG. 3) and a lower layer (60*b* of FIG. 3), a reference point is a boundary 60*c* of the upper and lower layers 60*a* and 60*b*.

The initial polishing controller 180*a* controls polishing performed at the initial plate portion 100*a* by using an endpoint detecting method or a fixed time method. The endpoint detecting method adopts an optical interferometric method, which is disclosed in Korean Patent Application No. 2002-34771 and U.S. Pat. No. 6,511,363. The optical interferometric method is well know in the art and will not be described in further detail. The fixed time method is where a worker directly sets polishing time according to associated data (e.g., polishing thickness and time) based on a kind of a to-be-polished layer and the layer is then polished for the set polishing time.

The intermediate polishing controller 180*b* controls polishing performed at the intermediate plate portion 100*b* by using an endpoint detecting method. The endpoint detecting method may adopt an optical interferometric method or a motor current control method. The motor current control method senses the variation of a load that is generated by a frictional difference of the layers (upper and lower layers 60*a* and 60*b*) to be applied to a motor. As previously stated, the intermediate polishing controller 180*b* controls the polishing to be performed until the upper layer 60*a* is completely polished at the intermediate plate portion 100*b*, and the lower layer 60*b* is exposed.

The final polishing controller 180*c* controls the polishing performed at the final plate portion 100*c* by using a variable time method based on a closed loop control. When the fixed time method is used for polishing, the thickness of the post-polish lower layer 60*b* differs from the target thickness. This is because lower layers 60*b* of wafers differ in thickness, and as the polishing process is performed, expendable supplies such as the polishing pad and the pad conditioner abrade, changing the polishing rate. According to the variable time method based on the closed loop control, a polishing rate upon a present state of the polishing apparatus 10 is computed from data such as polishing time and thickness of a currently polished wafer and then polishing time is automatically computed.

Figure 3:
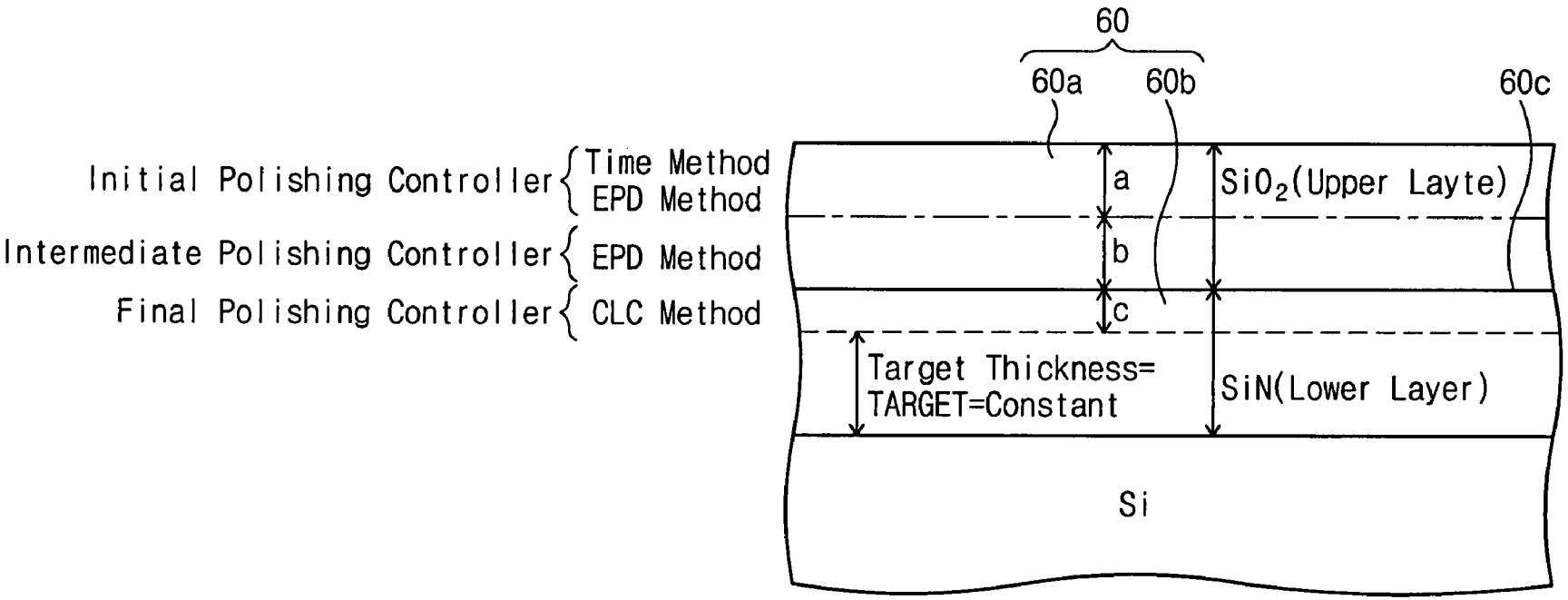
FIG. 3 is a cross-sectional view showing multi-layered regions polished at each plate portion in the case that multi-layers are polished according to an embodiment of the invention at plate portions, respectively.

In FIG. 3, an 'a' area is polished at the initial plate portion 100*a* by a fixed time method or an endpoint detecting method. A 'b' area is polished at the intermediate plate portion 100*b* by the endpoint detecting method, and a 'c' area is polished at the final plate portion 100*c* by a variable time method based on a closed loop control.

Figure 4:
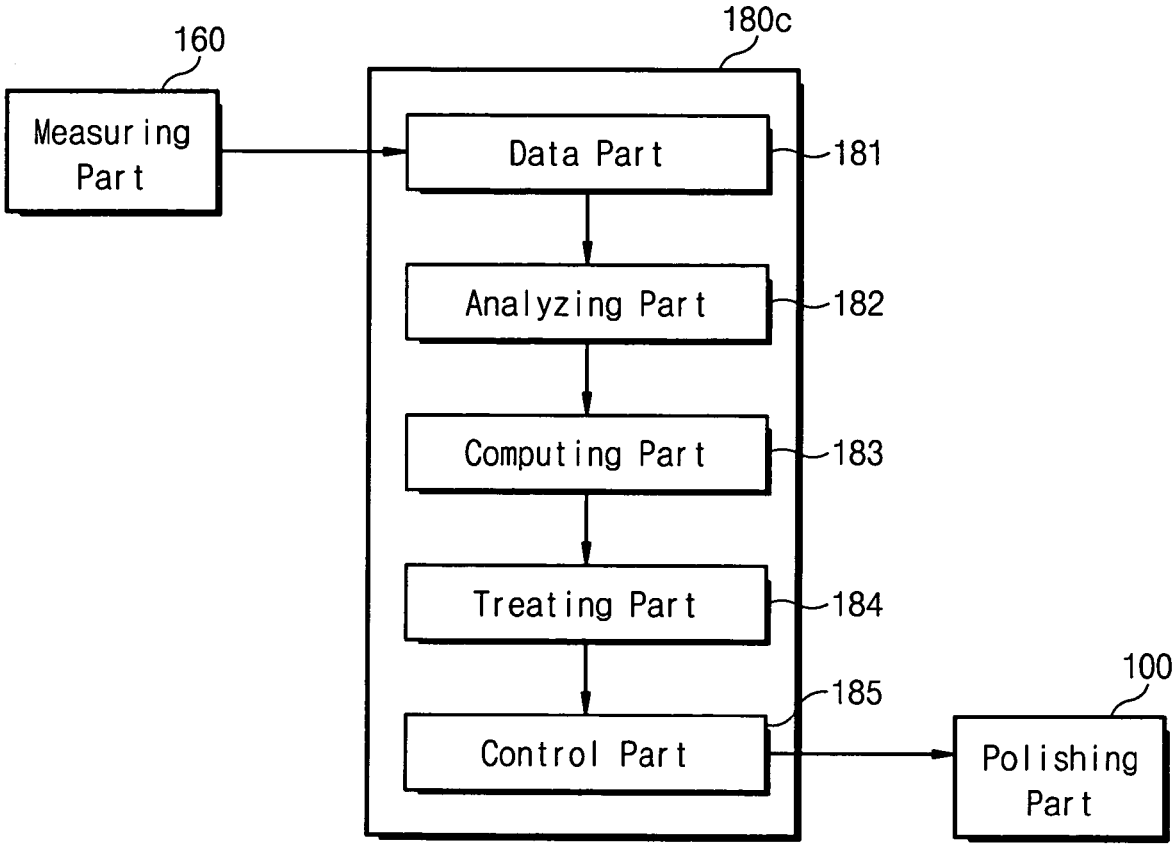
FIG. 4 shows a final polishing controller according to an embodiment of the invention.

As illustrated in FIG. 4, the final polishing controller 180*c* has a data part 181, an analyzing part 182, a computing part 183, a treating part 184, and a control part 185. The data part 181 receives data on pre- and post-polish thickness of a lower layer 60*b* of each wafer, which are measured at the measuring part 160, and data on polishing time required for polishing the wafer at a final polishing step. The analyzing part 182 analyzes a polishing rate of each wafer when it is polished, based on data stored in the data part 181. The computing part 183 combines one or more values analyzed from the analyzing part 182 to compute a current-state polishing rate (hereinafter referred to as "process polishing rate") of the polishing apparatus 10. The treating part 184 computes a polish time to be applied to a wafer that will be subjected to a current process. The control part 185 controls the polishing head assembly 140 such that polishing is performed at the final plate portion 100*c* during the polishing time computed at the treating part 184.

Now, the steps of computing a polishing time at the final polishing controller 180*c* will be described more fully. The final polishing controller 180*c* controls the polishing of lower layer 60*b* of a wafer to be polished to a target thickness.

We set:

PRE-THK$_i$ is a thickness of a lower layer 60*b* of a wafer which is not polished yet in an i$^{th}$ polishing process;

TARGET is a target thickness;

RR$_i$ denotes a process polishing rate;

PRE-THK$_K$ is a thickness of the lower layer 60*b* before performing a polishing process for a wafer subjected to a k$^{th}$ process (hereinafter referred to as "k$^{th}$ wafer");

POST-THK$_K$ is a thickness of the lower layer 60*b* after performing a final polishing process for the k$^{th}$ wafer; and T$_K$ is a polishing time of the k$^{th}$ wafer, wherein the wafer to be polished in the i$^{th}$ process means a wafer to be polished in a current process, and the k$^{th}$ wafer means a wafer that is already polished; and wherein k$^{th}$ wafers belong to the same lot as wafers that are being polished and are already polished and measured, or are wafers that belong to a lot polished just before.

The PRE-THK$_i$, PRE-THK$_K$, POST-THK$_K$, and T$_K$ are all stored in the data part 181. The analyzing part 182 analyzes a polishing rate RRK of the polishing apparatus 10 when a k$^{th}$ wafer is polished.

$$RR_K=(PRE\text{-}THK_K-POST\text{-}THK_K)/T_K \quad \text{[Equation 1]}$$

The computing part 183 uses the polishing rates RR$_K$ computed at the analyzing part 182 to compute a process polishing rate RR$_i$. In an exemplary embodiment, one of the polishing rates analyzed at the analyzing part 182 (polishing rate of a k$^{th}$ wafer) may be set as a process polishing rate RR$_i$. Preferably, the k$^{th}$ wafer is a (i-1)$^{th}$ wafer that has just been completely polished. However in the case that the (i-1)$^{th}$ wafer is not measured, the k$^{th}$ wafer is a wafer that is most currently measured.

In another exemplary embodiment, among the polishing rates analyzed at the analyzing part 182, a plurality of polishing rates are combined to compute a process polishing rate RR$_i$. For example, the process polishing rate RR$_i$ may be an average value of polishing rates of successively polished wafers, as shown by equation 2.

$$RR_i = \frac{\sum_{k=i-m}^{i-n} RR_k}{(m-n+1)} (i > m > n) \quad \text{[Equation 2]}$$

In this case, it is preferable to use polishing rates for wafers that are most currently measured. Generally, it is preferable to use an average value of about three to five polishing rates. For example, if using polishing rates of three wafers polished just prior to the wafer that is to be currently polished, a polishing rate RR$_i$ is obtained by equation 3.

$$RR_i = \frac{RR_{i-1} + RR_{i-2} + RR_{i-3}}{3} \quad \text{[Equation 3]}$$

In still another exemplary embodiment, polishing rates of a plurality of wafers are combined to obtain a process polishing rate RR$_i$ while giving a determined weight to the respective polishing rates.

$$RR_i = \sum_{k=i-m}^{i-n} [RR_k \times WEIGHT_k](i > m > n) \quad \text{[Equation 4]}$$

In this case, it is preferable to give a higher weight to polishing rates of currently polished wafers. If using polishing rates of three wafers polished just prior to the wafer that is currently being polished and sequentially giving weights 0.5, 0.3, and 0.2 to the three wafers, a process polishing rate RR$_i$ is obtained by equation 5.

$$RR_i=RR_{i-1}\times 0.5+RR_{i-2}\times 0.3+RR_{i-3}\times 0.2 \quad \text{[Equation 5]}$$

If the process polishing rate RR$_i$ is computed at the computing part 183, the treating part 184 determines a polishing time T$_i$ for polishing that is to be performed in a final polishing step. In an exemplary embodiment, a treating part 184 computes a polishing time T$_i$ according to equation 6.

$$T_i=(PRE\text{-}THK_i-\text{TARGET})/RR_i \quad \text{[Equation 6]}$$

Figure 5:
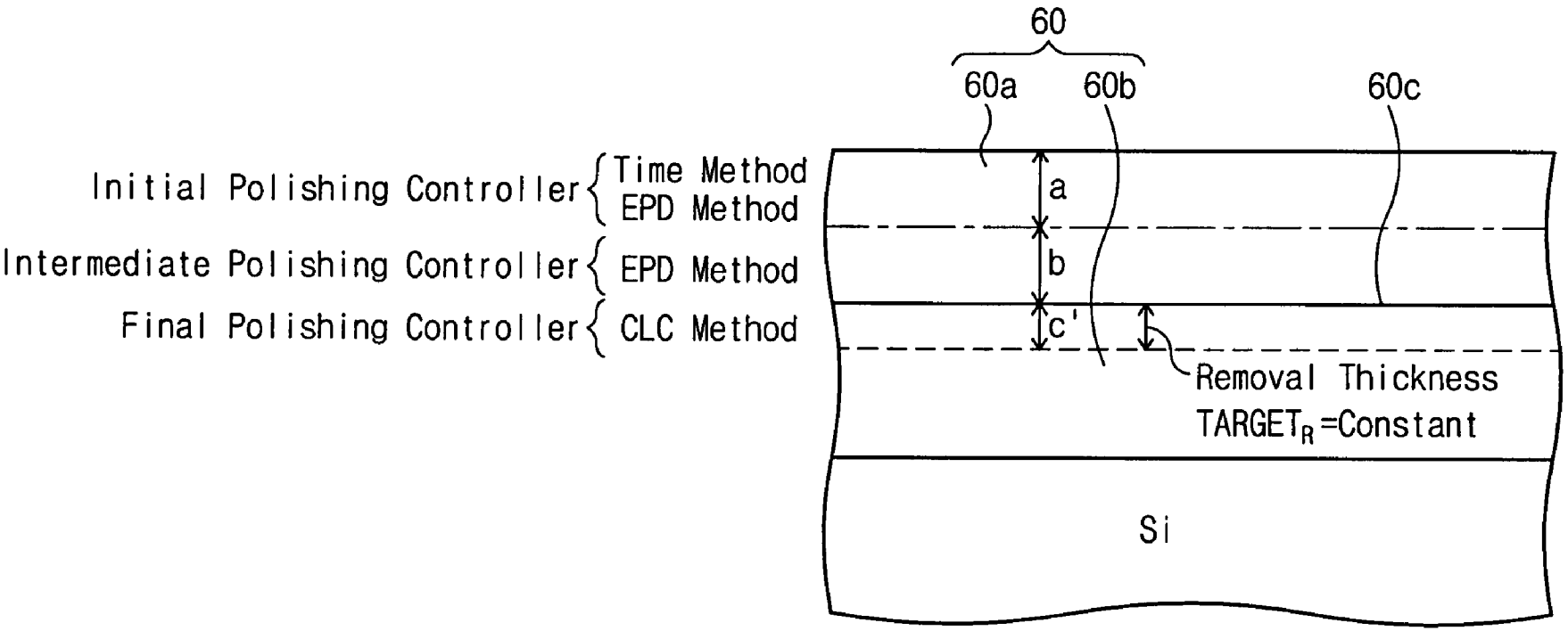
FIG. 5 is a cross-sectional view showing multi-layered regions polished at each plate portion according to an embodiment of the invention, respectively when they are set to have a uniform removal thickness.

In some cases, the thickness of lower layer 60*b* polished in a polishing process is more important than the thickness of lower layer 60*b* remaining on a wafer after polishing the same. In this case, a final polishing controller 180*c* controls a polishing time such that a layer removed at lower layer 60*b* of a wafer has a determined thickness. As illustrated in FIG. 5, a thickness corresponding to 'c' (hereinafter referred to as "removal thickness") is a constant. The treating part 184 may compute a polishing time $T_i$ according to equation 7.

$$T_i = \text{TARGET}_R / RR_i \quad \text{[Equation 7]}$$

wherein $\text{TARGET}_R$ represents a removal thickness.

In case of a wafer that is polished first from a corresponding lot, data on the polishing rate of a previously polished wafer is not stored. For this reason, the polishing time may be determined by a fixed time method. Namely, the polishing time may be determined depending upon the time that a worker directly inputs.

After a polishing process is completed, the thickness of lower layer 60*b* may be larger than the target thickness TARGET or the removed thickness of the lower layer 60*b* may be smaller than the removal thickness $\text{TARGET}_R$. In both cases, the wafer may be re-polished at the final plate portion 100*c*. Also preferably, the polishing time is determined by a time method based on a closed loop control.

As previously stated in the foregoing embodiment, a wafer is continuously polished at the initial plate portion 100*a*, the intermediate plate portion 100*b*, and the final plate portion 100*c*. In another embodiment, a polishing part uses only an intermediate plate portion 100*b* and a final plate portion 100*c*. At the intermediate plate portion 100*b*, a wafer is polished until a lower layer 60*b* is exposed. At the final plate portion 100*c*, the wafer is polished until the lower layer 60*b* reaches a target thickness.

Alternatively, the polishing part 130 has only one plate portion to polish a wafer until the lower layer 60*b* is exposed (an endpoint detection method enables a worker to detect whether the lower layer 60*b* is exposed or not), and then the wafer is continuously polished using a variable time method based on a closed loop control.

Figure 6:
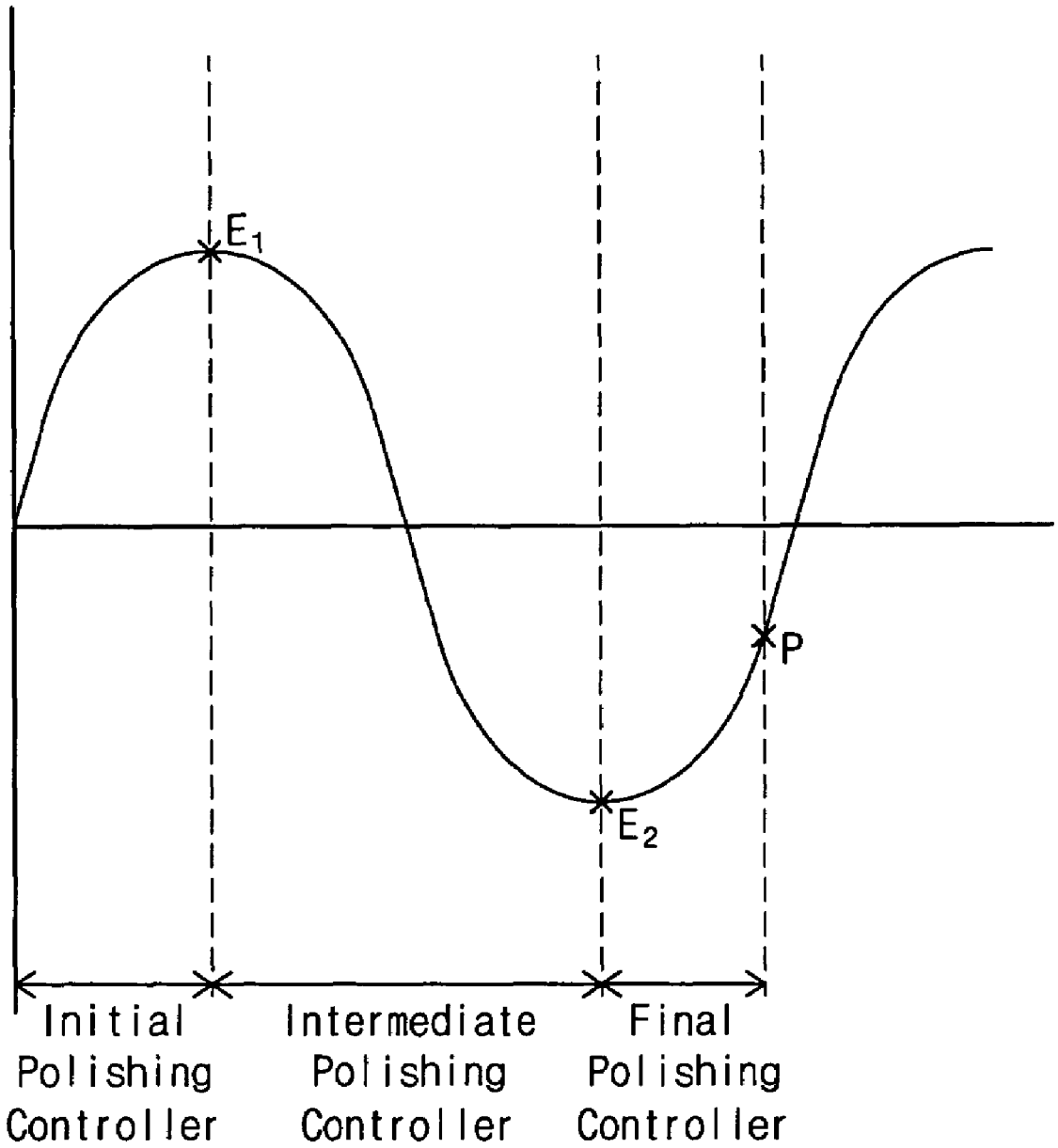
FIG. 6 shows a waveform obtained using optical interferometry.

While the foregoing embodiments describe polishing a multi-layered wafer, the technology may be applied to a single layer. In this case, a wafer is polished to a predetermined thickness at an initial plate portion 100*a* using a fixed time method or an endpoint detection method based on optical interferometry. Thereafter, the wafer moves to an intermediate plate portion 100*b* to be polished up to a reference point using an endpoint detection method based on optical interferometry. For example, if a waveform obtained using optical reference is a waveform shown in FIG. 6 and a final target thickness is a thickness corresponding a point 'P', a wafer is polished at an intermediate plate portion 100*b* up to a thickness corresponding to an upper point or lower point E2 that is most adjacent to the point 'P' of the waveform. Thereafter, the wafer is polished up to a target thickness using a time method based on a closed loop control. From the above equations, both $\text{PRE-THK}_i$ and $\text{PRE-THK}_K$ of the wafer become a constant of the same thickness. That is to say, $\text{PRE-THK}_i = \text{PRE-THK}_K = \text{PRE-THK}$ (constant). In the case that a wafer is polished at the initial plate portion 100*a* using optical interferometry, a polished portion of the wafer would be a portion corresponding to an upper point E1.

Figure 7:
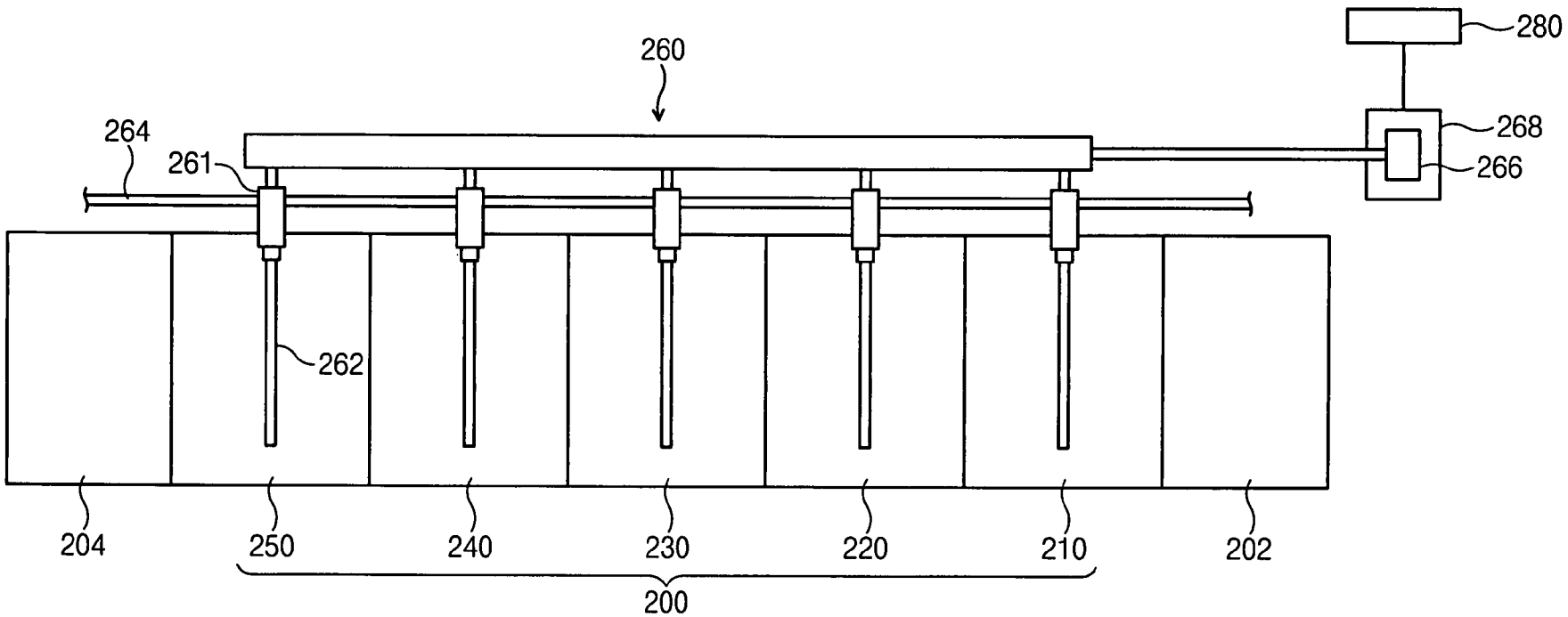
FIG. 7 shows the cleaning apparatus of FIG. 1.
Figure 8:
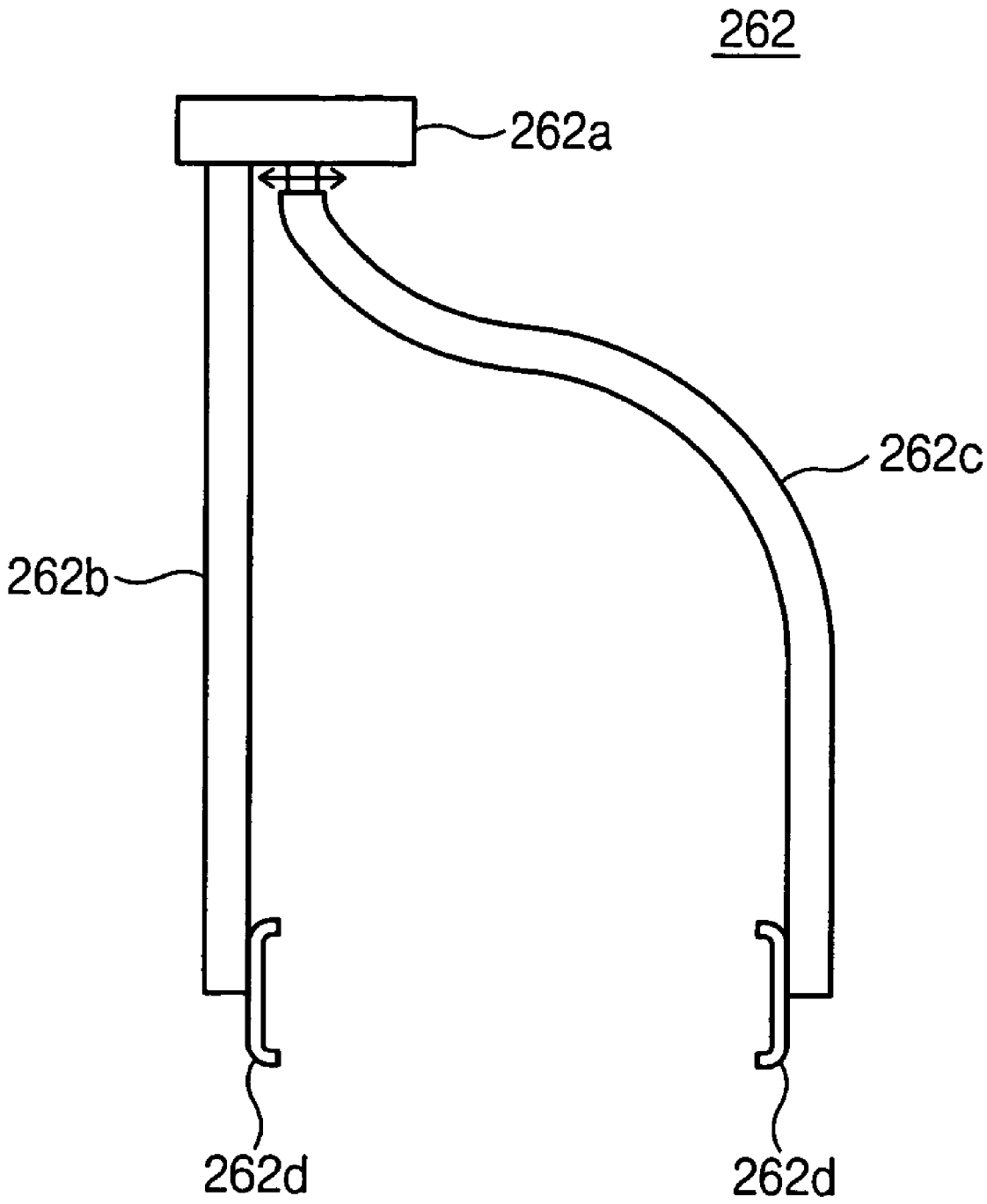
FIG. 8 is a front view of a holding part of the cleaning apparatus of FIG. 7.

A wafer completely polished at the polishing apparatus 10 is transferred to a cleaning apparatus 20. As illustrated in FIG. 7, the cleaning apparatus 20 includes a loading unit 202, a plurality of cleaning modules 200, an unloading unit 204, a transfer unit 260, and a control unit 280. After a polishing process is completed, a wafer is placed on the loading unit 202. The placed wafer is transferred to the cleaning module 200 by the transfer unit 260 to be cleaned. A completely cleaned wafer is placed on the unloading unit 204 and then is put into a carrier by a transfer robot 42. Although not shown in this figure, a position switch may be installed at the loading unit 202 and the unloading unit 204 to make a horizontally placed wafer stand upright. The transfer unit 260 includes a plurality of holding parts 262, a horizontal moving part 266, and a vertical moving part 268. The holding part 262 is docked with a guide rail 264 by a bracket 261 and takes a straight line motion along the guide rail 264 by means of the vertical moving part 268. The holding part 262 is disposed over the cleaning module 200. The holding part 262 vertically moves up and down when a wafer is loaded/unloaded to/from the respective cleaning modules 200 and takes a straight line motion in a horizontal direction when a wafer is transferred between the cleaning modules 200. As illustrated in FIG. 8, the holding part 262 has a supporter 262*a* and two arms 262*b* and 262*c*. The arm 262*b* is fixed to the supporter 262*a*, and the arm 262*c* is mounted at the supporter 262*a* to be movable therealong. Hands 262*d* are disposed at bottoms of the arms 262*b* and 262*c* to hold a wafer, respectively.

Each of the cleaning modules 200 includes a rinsing module 210, an initial chemical-treating module 220, an intermediate chemical-treating module 230, a final chemical-treating module 240, and a drying module 250, which are disposed in the order named between the loading unit 202 and the unloading unit 204. The holding parts 262 simultaneously move horizontally and vertically. Alternatively, the holding parts 262 may independently move horizontally and vertically. At the rinsing module 210, a wafer rinsing process is performed using a rinsing solution such as deionized water (DI water). At the initial chemical-treating module 220, a cleaning process is performed using an etchant such as HF to remove metallic particles attached to a wafer. In the intermediate chemical-treating module 230, a cleaning process is performed using a chemical such as ammonia to prevent particles or the like from re-attaching to the wafer. At the final chemical-treating module 240, a cleaning process is performed using a mixed chemical of ammonia, hydrogen peroxide, and DI water to remove organic matters on the wafer and finally prevent re-attachment of particles. At the drying module 250, the transfer unit 260 is controlled to sequentially perform a rinsing process using DI water, a cleaning process using hydrofluoric acid (HF), a cleaning process using ammonia, a cleaning process using a mixed chemical, and a drying process.

As previously stated in the foregoing embodiment, the cleaning modules 200 are disposed according to the order of processes performed for a wafer. However, there may be cases that a conventional apparatus should be used. In theses cases, the transfer unit 260 has about one to three holding parts 260 to perform the processes in the above order named. The holding parts 260 may independently move horizontally and vertically.

In a typical cleaning apparatus, a wafer is cleaned using a mixed chemical before being cleaned using HF. Thereafter, the wafer is transferred to special wet station equipment to re-perform cleaning and drying processes using a mixed chemical. On the other hand, in this embodiment, a wafer is transferred to equipment for the next process (e.g., deposition process) without being transferred to wet station equipment because a cleaning process using a mixed chemical is performed last. In addition, the intermediate chemical-treating module 230 may be omitted and the cleaning apparatus 20 may have a plurality of final chemical-treating modules 440 in which a cleaning process is performed using a mixed chemical. In this case, a wafer is sequentially subjected to a rinsing process using DI water, a cleaning process using a mixed chemical, a cleaning process using HF, a cleaning process using ammonia, a cleaning process using a mixed chemical, and a drying process. Alternatively, a cleaning module 200 for performing a cleaning process using another etchant may be additionally installed at the cleaning apparatus 20 as well as the above-described cleaning modules 200 or a plurality of identical cleaning modules 200 may be installed.

Figure 9:
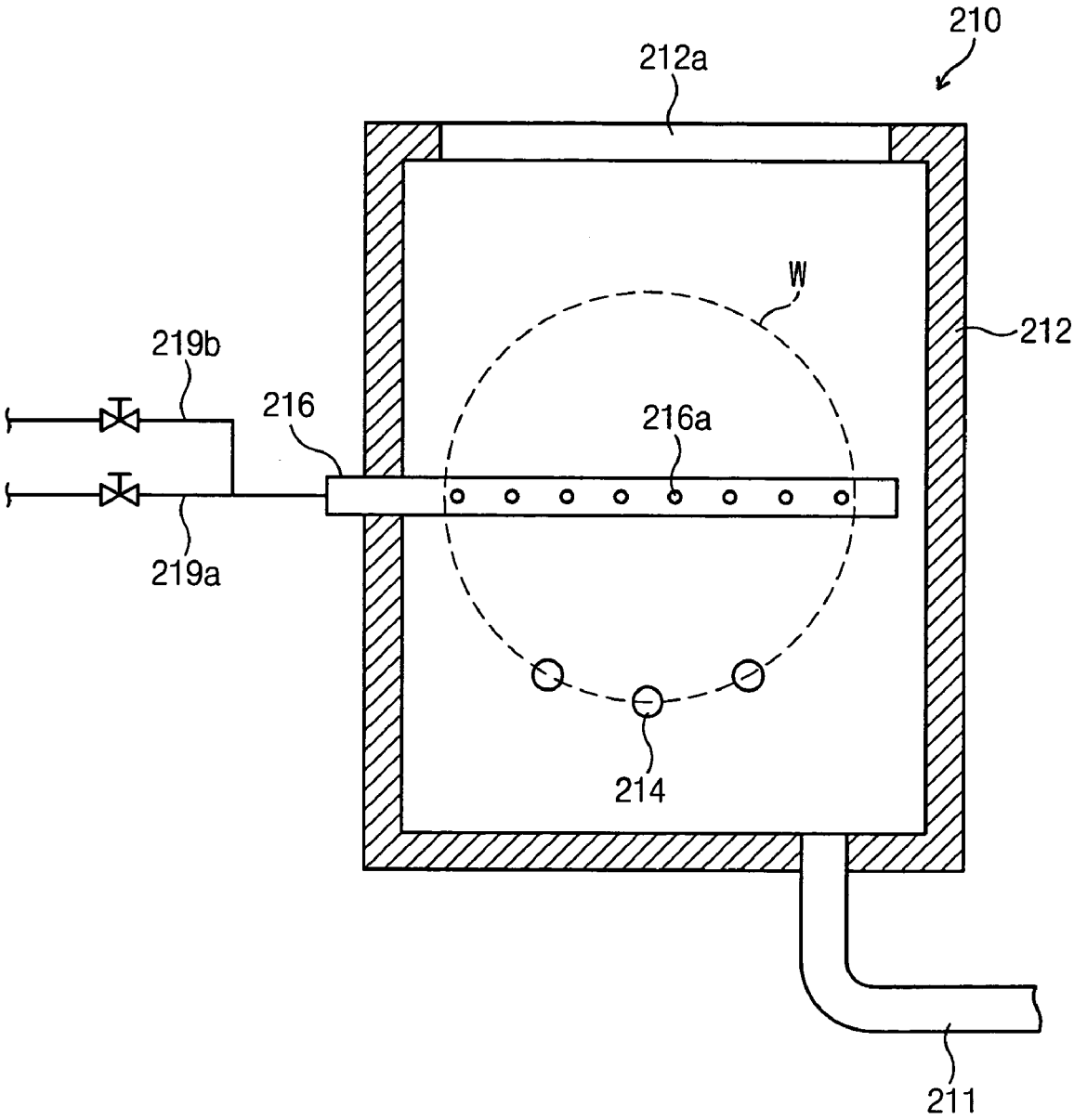
FIG. 9 shows a rinsing module of the cleaning apparatus of FIG. 7.

As illustrated in FIG. 9, the cleaning module 210 has a housing 212 having a top where a slot 212*a* is formed. Wafers enter and exit through the slot 212*a*. A drain pipe 211 is connected to a bottom of the housing 212. A rinsing solution is drained through the drain pipe 211. A wafer is inserted into a slot (not shown) formed at each supporting rod 214 which rotates during a process. A nozzle 216 is inserted into the housing 212. The nozzle 216 is horizontally disposed to pass the center of a wafer. A plurality of injection holes 216*a* are formed on the nozzle 216. The wafer rotates while DI water is injected onto the wafer. A rinsing solution supply pipe 219*a* and a dry gas supply pipe 219*b* are connected to the nozzle 216. The rinsing solution supply pipe 219*a* is configured for supplying DI water, and the dry gas supply pipe 219*b* is configured to supply drying gas. If the wafer is completely rinsed, dry gas such as nitrogen is supplied from the nozzle 216 to remove DI water attached to the wafer. A holding part 262 transfers the wafer from cleaning module 210 to an initial chemical-treating module 220. Wafers are transferred dried, thereby preventing DI water left on the wafers from dropping on the outer walls of modules 200.

Figure 10:
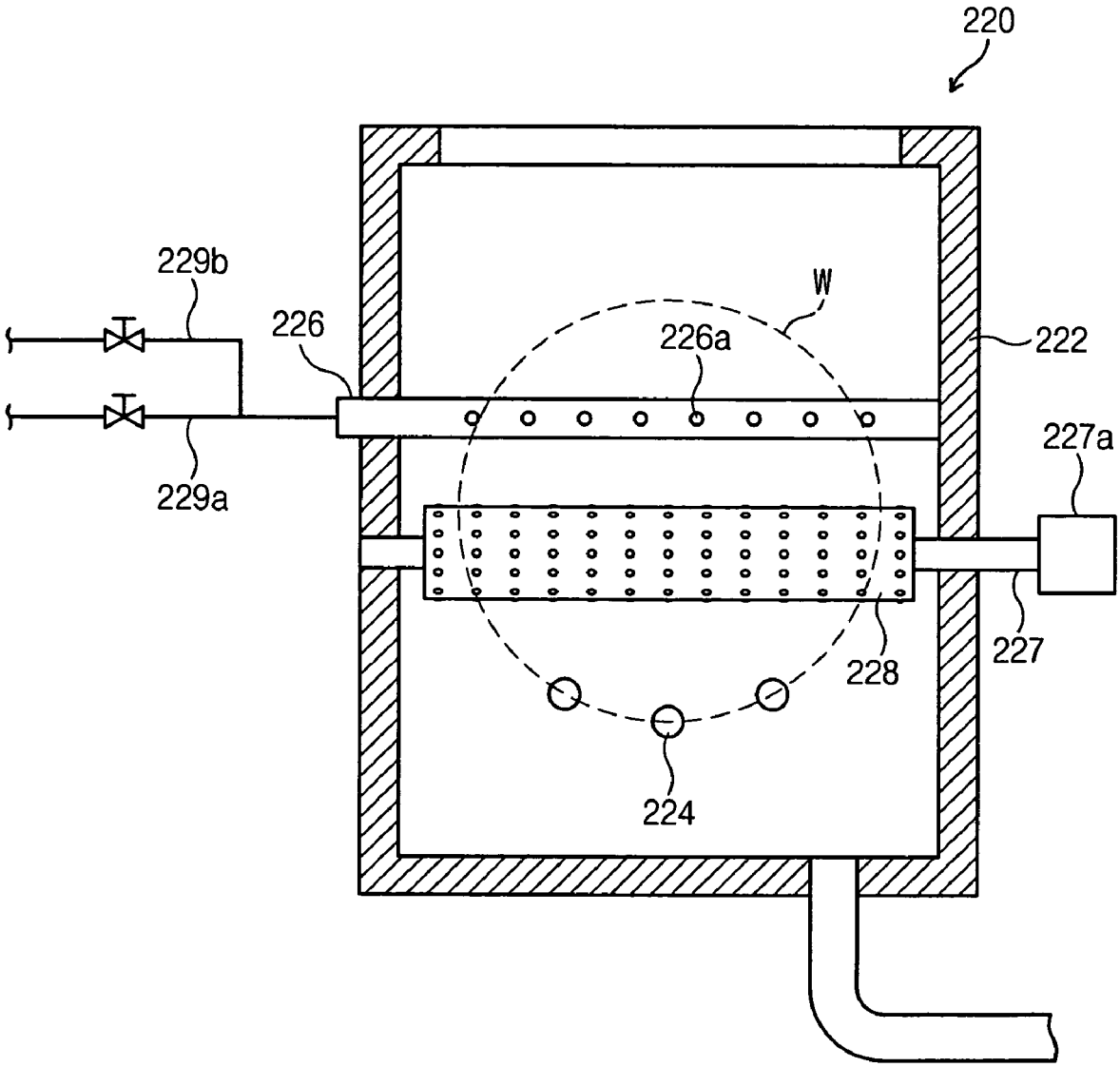
FIG. 10 shows an initial chemical treating module of the cleaning apparatus of FIG. 7.

As illustrated in FIG. 10, the initial chemical-treating module 220 has a housing 222, a supporter 224, a nozzle 226, and brushes 228. The housing 222 and the supporter 224 are similar to the housing 212 and the supporter 214 of the rinsing module 210 and will not be described in further detail. The brushes 228 are installed in the housing 222. A shaft 227 is inserted into the center of the brushes and is rotated by a motor 227*a* during a wafer. The brushes 228 may take a straight line motion in an opposite direction so that a wafer may be placed therebetween. A nozzle is disposed over the brushes 228. An etchant supply pipe 229*a* and a dry gas supply pipe 229*b* are connected to the nozzle 226. The etchant supply pipe 229*a* is configured for supplying HF, and the dry gas supply pipe 229*b* is configured for supplying a dry gas. A plurality of injection holes 226*a* are formed at the nozzle 226. While HF is supplied from the nozzle 226, the wafer rotates. After the cleaning process is completed, the wafer is dried using a dry gas. An intermediate chemical-treating module 230 has the same configuration as the initial chemical-treating module 220, but uses ammonia instead of HF as the chemical treatment. Alternatively, the wafer may be rinsed or cleaned by dipping the wafer in these modules. In this case, the nozzle 226 is preferably disposed in an upper portion in the housing 222.

Figure 11:
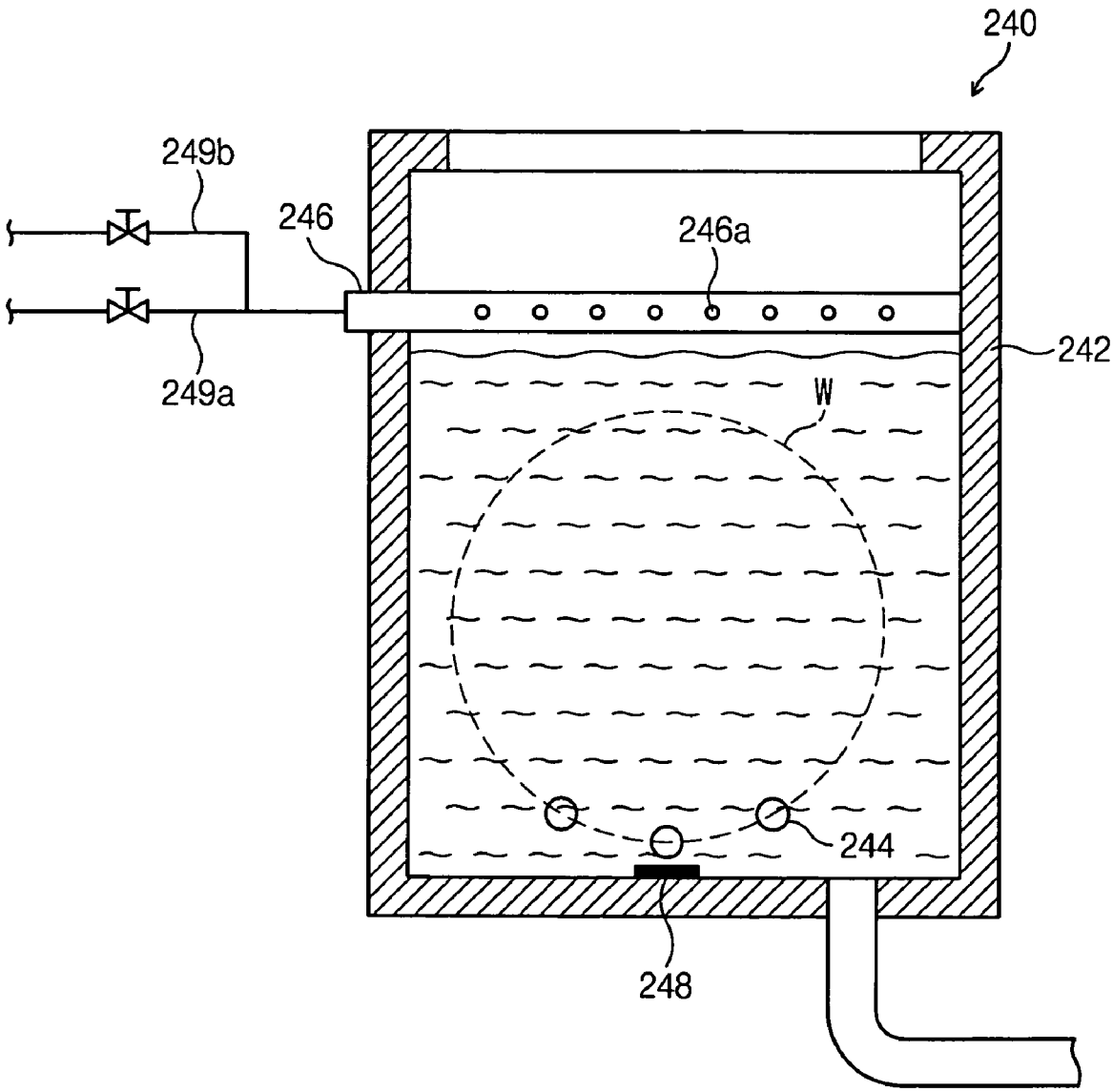
FIG. 11 shows a final chemical treating module of the cleaning apparatus of FIG. 7.

As illustrated in FIG. 11, the final chemical-treating module 240 has a housing 242, a supporter 244, a nozzle 246, and a megasonic wave generator 248. The housing 242 and the supporter 244 are similar to the housing 212 and the supporter 214 of the cleaning module 210 and will not be described in further detail. At the final chemical-treating module 240, the wafer is dipped in a mixed chemical to be cleaned. A nozzle 246 is disposed at an upper portion in the housing 242. An etchant supply pipe 249*a* and a dry gas supply pipe 249*b* are connected to the nozzle 246. The etchant supply pipe 249*a* is configured for supplying an etchant, and the dry gas supply pipe 249*b* is configured for supplying a dry gas. A plurality of injection holes 226*a* are formed on the nozzle 246. The above-mentioned mixed chemical is used as the etchant, in which ammonia, hydrogen peroxide, and DI water may be mixed at a ratio of 1:4:20. The megasonic wave generator 248 is mounted on a bottom of the housing 242 to apply a wave form to the mixed chemical.

As previously described in FIG. 9 through FIG. 11, an etchant or a rinsing solution and a dry gas are supplied through the same nozzle in the respective modules 200. Alternatively, a nozzle for supplying an etchant or a rinsing solution and a nozzle for supplying a dry gas may be installed independently. In this case, the nozzle for supplying an etchant or a rinsing solution is preferably disposed above the nozzle for supplying a dry gas. Particularly, the nozzle for supplying a dry gas is preferably disposed in an upper portion of the housing.

A wafer, which is completely cleaned using an etchant, moves to the drying module 250 to be dried. The drying module 250 may perform a drying process using Marangoni effect. A drying method using the Marangoni effect is disclosed in Korean Patent Application No. 2003-47511 and No. 2002-93248, and a spin dry method is disclosed in U.S. Pat. No. 5,829,256, which will not be described in further detail.

Figure 12:
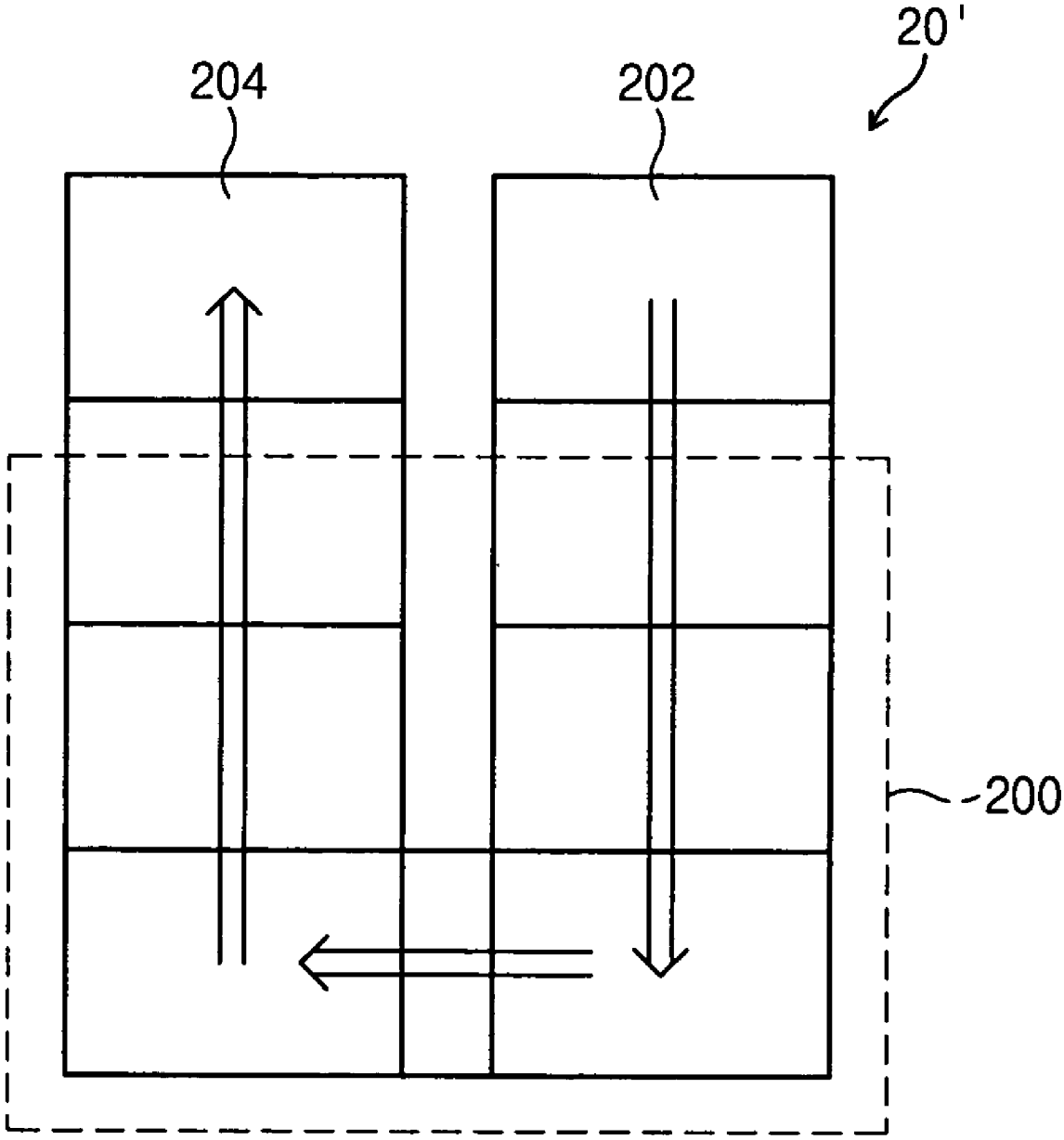
FIG. 12 shows another example of the cleaning apparatus of FIG. 1.

FIG. 12 illustrates a cleaning apparatus 20' having another arrangement of a loading unit 202, an unloading unit 204, and a plurality of cleaning modules 200, in which arrows indicate a wafer transfer direction. Referring to FIG. 12, the cleaning modules 200 are arranged in two lines. Therefore, the cleaning apparatus 20 has a substantially U-shape. The loading unit 202 and a part of the cleaning modules 200 are sequentially arranged in a first column adjacent to the polishing apparatus 10, and the other modules 200 and the unloading unit 204 are arranged in a second column. The foregoing arrangement is advantageous for the use of many cleaning modules 200.

Figure 13:
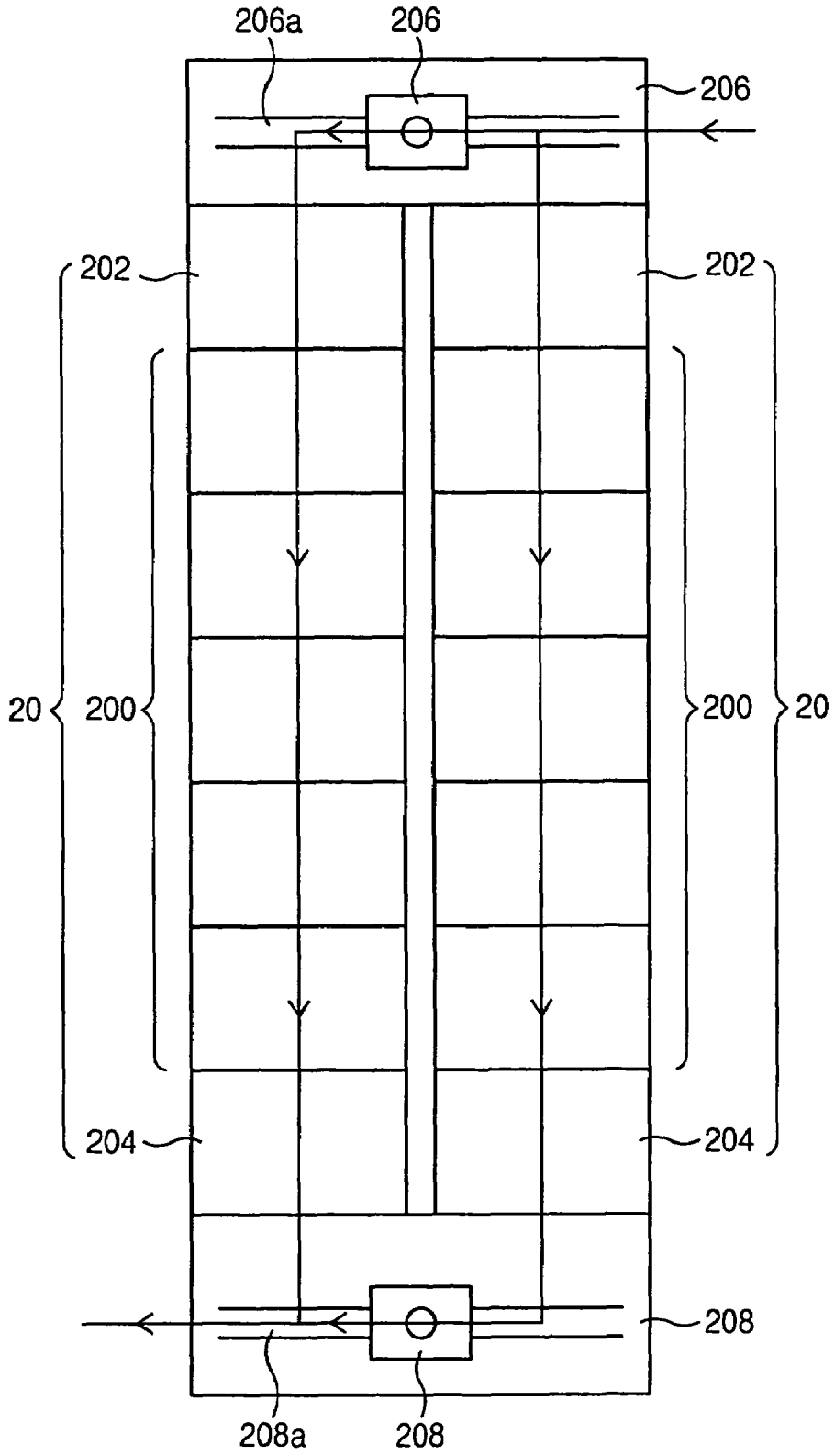
FIG. 13 shows an arrangement of a plurality of cleaning apparatuses are arranged according to another embodiment of the invention.

FIG. 13 illustrates the case that a plurality of cleaning apparatuses 20 are disposed, in which arrows indicate a wafer transfer direction. Two or more cleaning apparatuses 20 are juxtaposed at one side of the polishing apparatus 10. A loading unit 202 and an unloading unit 204 are disposed at the respective cleaning apparatuses 20. A distributing part 206 is disposed at one side of the loading units 202. A transfer robot 206*a* is installed in the distributing part 206 to transfer a wafer from the polishing apparatus 10 to the respective loading units 202. Another distributing part 208 is disposed at one side of the unloading units 204. A transfer robot 208*a* is installed in the distributing part 208 to transfer a wafer from the cleaning apparatus 20 to a measuring part 160. The foregoing configuration makes it possible to prevent piling-up of wafers in the case where time required for cleaning a wafer is longer than time required for polishing a wafer.

Figure 14:
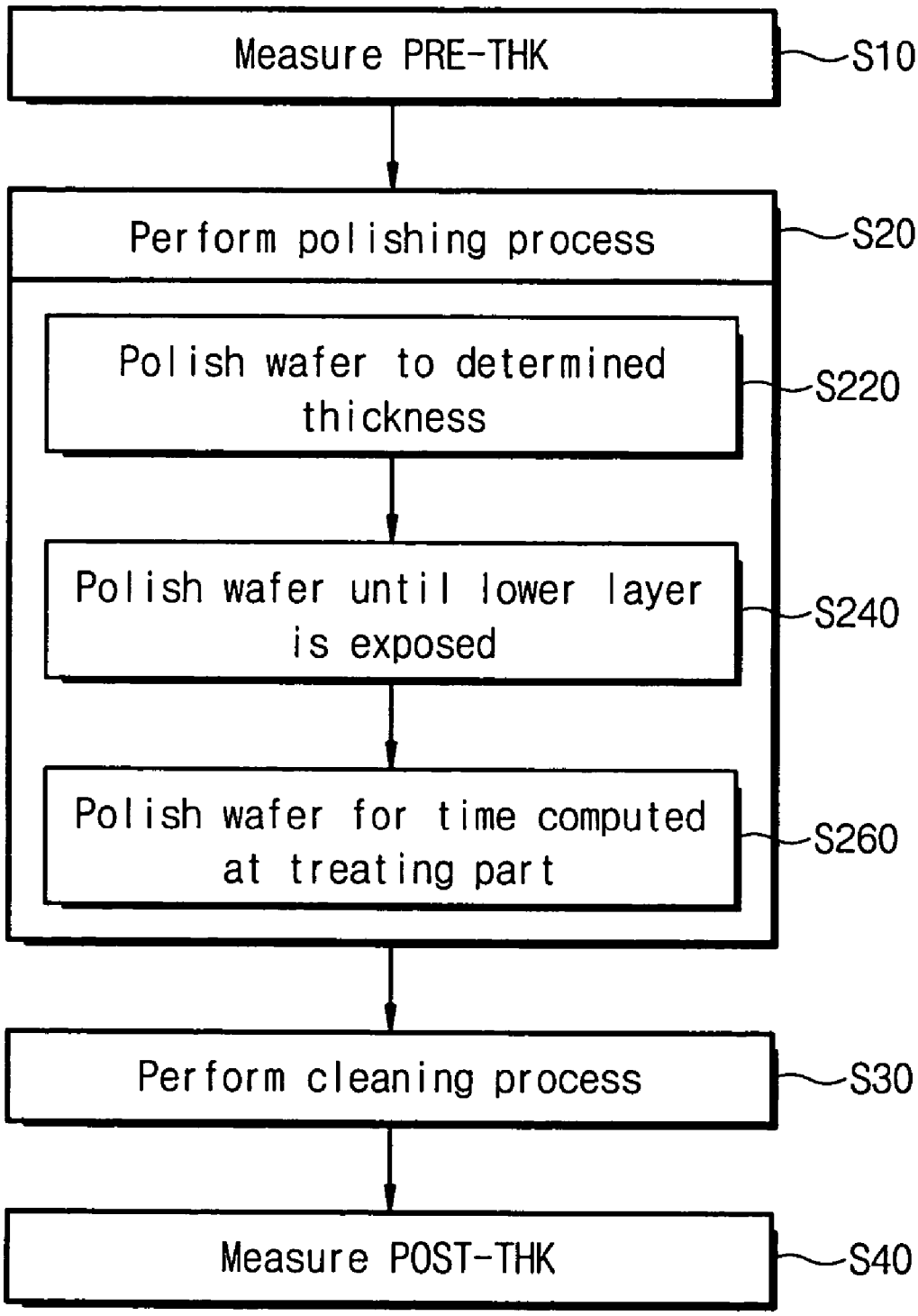
FIG. 14 is a flowchart explaining a substrate treating method according to an embodiment of the present invention.
Figure 15:
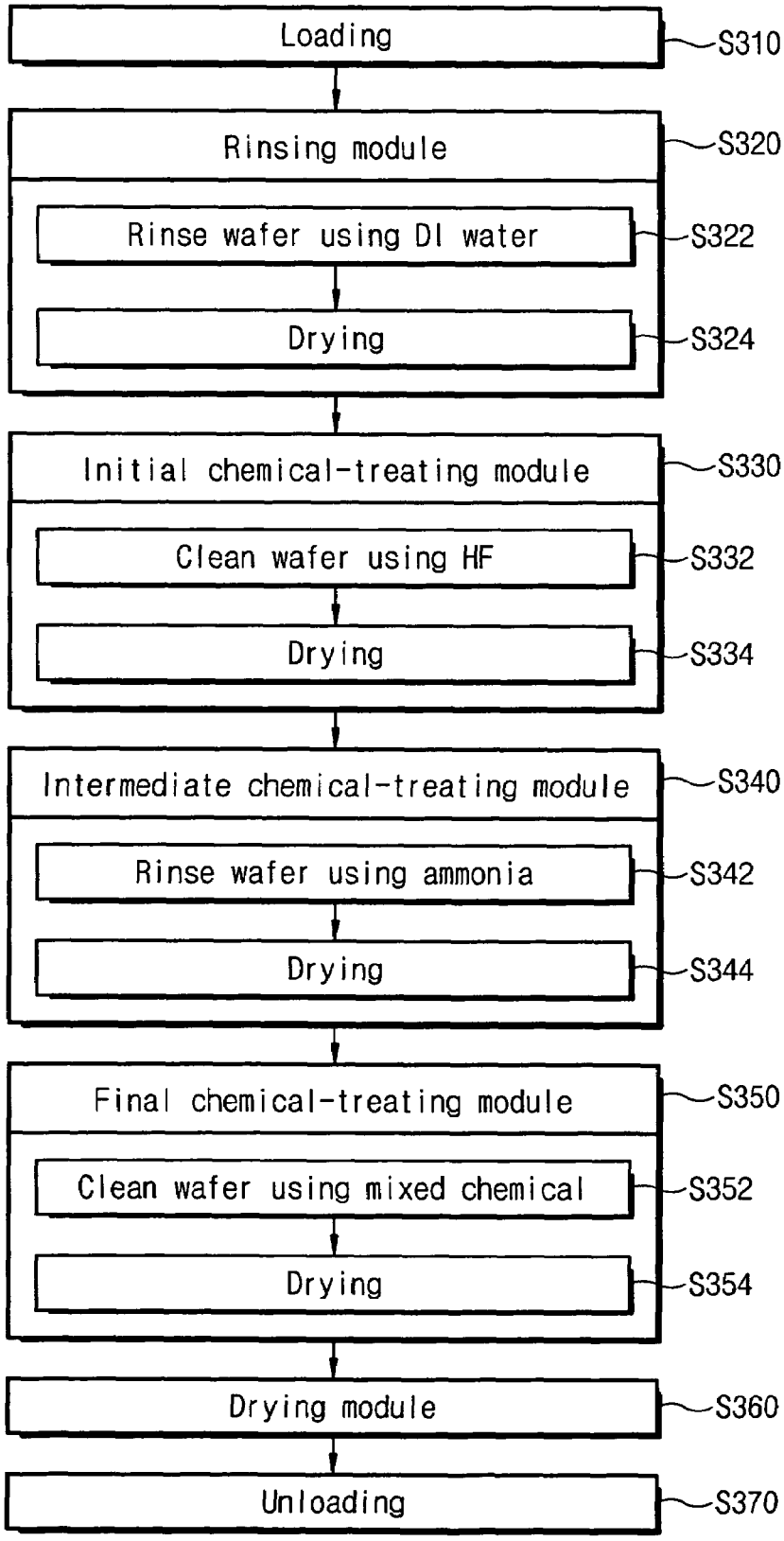
FIG. 15 is a flowchart showing the steps of the cleaning process in FIG. 14.

FIG. 14 is a flowchart for explaining a substrate treating method according to the present invention, and FIG. 15 is a flowchart showing the steps of a cleaning process shown in FIG. 14. As illustrated in FIG. 14 and FIG. 15, a thickness of a lower layer 60*b* of a wafer is measured at measuring part 160 and the measured data is transmitted to data part 181 in step S10. A wafer polishing process is performed at a polishing part in step S20. The wafer is transferred to an initial plate portion 100*a* of polishing apparatus 10 to be polished to a determined thickness in step S220. The determined thickness may be detected using a time method or an endpoint detection method. The wafer is transferred to an intermediate plate portion 100*b* to be polished until the lower layer 60*b* is exposed in step S240. The wafer is transferred to a final plate portion 100*c* to be polished for polishing time computed at a treating part 184 in step S260. A method for determining polishing time is already described above and will not be described any further. When the polishing process is completed, the wafer is transferred to a loading unit of a cleaning apparatus 20 to perform a cleaning process at steps S30 and S310. The wafer is transferred to cleaning module 210 in step S320. At the cleaning module 210, the wafer is rinsed first using DI water in step S322. Then the wafer is dried using a dry gas in step S324. When the rinsing process is completed, the wafer is transferred to initial chemical-treating module 220 in step S330. At the initial chemical-treating module 220, the wafer is cleaned using HF in step S332. Then the wafer is dried using a dry gas in step S334. The wafer is transferred to intermediate chemical-treating module 240 in step S340. At the intermediate chemical-treating module 240, the wafer is cleaned using ammonia in step S342. Then the wafer is dried using a dry gas in step S344. Then the wafer is transferred to a final chemical-treating module 240 (S350). At the final chemical-treating module 240, the wafer is cleaned using a mixed chemical in step S352. Then the wafer is dried using a dry gas in step S354. The wafer is dried at the drying module 250 in step S360. The wafer is transferred to an unloading unit in step S370. At measuring part 160, a thickness of a remaining lower layer 60*b* is measured and the measured data is transmitted to data part 181 in step S40. Alternatively, the step S20 may be followed directly by the step S40, and the step S10 may be omitted if the thickness of the lower layer 60*b* is measured beforehand in a previous process.

According to an embodiment of the present invention, when a layer is polished from a wafer, a polished thickness of the layer is accurately controlled in spite of abrasion from a polishing pad or the like. In a cleaning process performed following the polishing process, the wafer is finally cleaned using a mixed chemical containing ammonia, hydrogen peroxide, and DI water. Therefore, the wafer need not be re-cleaned at a wet station. The wafer exits from each cleaning module dried by use of the dry gas, thereby preventing contamination of an apparatus.

Although several embodiments of the present invention have been described in detail for purposes of illustration, various modifications may be made without departing from the scope and spirit of the invention. Thus, the invention is not to be limited, except as by the appended claims.

What is claimed is:

1. A method for treating a substrate, the method comprising:

chemically mechanically polishing the substrate in an intermediate polishing step;

chemically mechanically polishing the substrate in a final polishing step and cleaning the substrate subsequent to chemically mechanically polishing the substrate, wherein the intermediate polishing step polishes the substrate to a reference point by using an endpoint detection method, and wherein the final polishing step includes computing a polishing time of the final polishing step from data measured during a final polishing step on a previously polished substrate.

2. The method of claim 1, wherein computing a polishing time of the final polishing step from data measured during a final polishing step on a previously polished substrate includes:

measuring a polishing rate and tinal polished thickness of the previously polished substrate;

computing a new polishing rate of the final polishing step from the measured polishing rate of the previously polished substrate; and computing the polishing time of the final polishing step from the new polishing rate.

3. The method of claim 2, wherein the substrate is multi-layered and the reference point in the intermediate polishing step is a boundary of an upper layer and a lower layer.

4. The method of claim 3, wherein the final polishing step polishes the substrate such that a thickness of the lower layer reaches a target thickness.

5. The method of claim 2, wherein the new polishing rate of the final polishing step is the measured polishing rate of the previously polished substrate.

6. The method of claim 4, wherein the new polishing rate of the final polishing step is computed by combining measured polishing rates of a plurality of previously polished substrates.

7. The method of claim 6, wherein the polishing time of the final polishing step is computed by calculating a difference between a thickness of the lower layer prior to the final step of polishing and the target thickness, and dividing that difference by an average of the measured polishing rates of a plurality of previously polished substrates.

8. The method of claim 6, wherein the polishing time of the final polishing step is computed by calculating a difference between a thickness of the lower layer prior to the final step of polishing and the target thickness, and dividing that difference by an average of measured polishing rates of three previously polished substrates.

9. The method of claim 4, wherein the new polishing rate of the final polishing step is computed by combining weighted polishing rates of a plurality of previously polished substrates.

10. The method of claim 9, wherein the polishing time of the final polishing step is computed by calculating a difference between a thickness of the lower layer prior to the final step of polishing and the target thickness, and dividing that difference by a weighted average of measured polishing rates of a plurality of previously polished substrates.

11. The method of claim 4, further comprising repeating chemically mechanically polishing the substrate in the final polishing step when the thickness of the lower layer is greater than the target thickness.

12. The method of claim 3, wherein the final polishing step polishes the substrate such that a thickness of material removed from the lower layer reaches a target thickness.

13. The method of claim 12, wherein the new polishing rate of the final polishing step is the measured polishing rate of the previously polished substrate.

14. The method of claim 12, wherein the new polishing rate of the final polishing step is computed by combining measured polishing rates of a plurality of previously polished substrates.

15. The method of claim 14, wherein the polishing time of the final polishing step is computed by dividing the target thickness of material removed from the lower layer by an average of the measured polishing rates of a plurality of previously polished substrates.

16. The method of claim 14, wherein the polishing time of the final polishing step is computed by dividing the target thickness of material removed from the lower layer by an average of the measured polishing rates of three previously polished substrates.

17. The method of claim 12, wherein the new polishing rate of the final polishing step is computed by combining weighted polishing rates of a plurality of previously polished substrates.

18. The method of claim 17, wherein the polishing time of the final polishing step is computed by dividing the target thickness of material removed from the lower layer by a weighted average of measured polishing rates of a plurality of previously polished substrates.

19. The method of claim 12, further comprising repeating polishing the substrate in the final polishing step when the thickness of material removed from the lower layer is less than the target thickness.

20. The method of claim 3, wherein the endpoint detecting method is an optical interferometric method.

21. The method of claim 3, wherein the endpoint detecting method is a motor current control method.

22. The method of claim 2, wherein the substrate is a single layer and the endpoint detecting method is an optical interferometric method.

23. The method of claim 2, further comprising polishing the substrate in an initial polishing step prior to polishing the substrate in the intermediate polishing step, wherein the initial polishing step polishes the substrate to a predetermined thickness.

24. The method of claim 23, wherein the initial polishing step polishes the substrate using an endpoint detecting method.

25. The method of claim 23, wherein the initial polishing step polishes the substrate for a predetermined amount of time.

26. The method of claim 1, further comprising:

loading the stibstrate onto a cleaning apparatus;

cleaning the substrate using deionized water (DI water);

cleaning the substrate in an initial chemical cleaning step using a cleaning solution including hydrofluoric acid (HF);

cleaning the substrate in a final chemical cleaning step by dipping the substrate in a bath including a cleaning solution of ammonia, hydrogen peroxide, and DI water;

drying the substrate in a drying step; and unloading the substrate from the cleaning apparatus.

27. The method of claim 26, wherein cleaning the substrate in the final cleaning step includes applying a megasonic wave to the bath containing the cleaning solution.

28. The method of claim 26, further comprising cleaning the substrate in an intermediate cleaning step following cleaning the substrate in the initial cleaning step, wherein cleaning the substrate in the initial cleaning step includes cleaning the substrate with a brush, and wherein cleaning the substrate in the intermediate cleaning step includes using a cleaning solution including ammonia and brushing the substrate.

29. The method of claim 26, wherein drying the substrate in the drying step includes drying the substrate using a Marangoni effect.

* * * * *

UNITED STATES PATENT AND TRADEMARK OFFICE

CERTIFICATE OF CORRECTION

PATENT NO. : 7,196,011 B2
APPLICATION NO. : 11/036865
DATED : March 27, 2007
INVENTOR(S) : Chan-Woo Cho et al.

It is certified that error appears in the above-identified patent and that said Letters Patent is hereby corrected as shown below:

Column 4, line 32, the word “10b” should read -- 100b --;
Column 12, line 5, the word “tinal” should read -- final --;
Column 14, line 5, the word “stibstrate” should read -- substrate --.

Signed and Sealed this

Second Day of September, 2008

JON W. DUDAS
*Director of the United States Patent and Trademark Office*